United States Patent [19]

Davis et al.

[11] 4,305,730

[45] Dec. 15, 1981

[54] CORROSION-INHIBITED ALCOHOL MOTOR FUEL COMPOSITION

[75] Inventors: Marshal E. Davis, Poughkeepsie; Kenneth L. Dille, Wappingers Falls, both of N.Y.

[73] Assignee: Texaco Inc., White Plains, N.Y.

[21] Appl. No.: 122,161

[22] Filed: Feb. 19, 1980

[51] Int. Cl.[3] ..... C10L 1/18

[52] U.S. Cl. ..... 44/53; 44/66; 252/396

[58] Field of Search ..... 44/53, 66; 252/396

[56] References Cited

U.S. PATENT DOCUMENTS

| | | | |
|---|---|---|---|
| 2,632,695 | 3/1953 | Landis | 44/66 |
| 3,068,081 | 12/1962 | Hager et al. | 44/53 |
| 3,925,030 | 12/1975 | Garth | 44/66 |
| 4,185,594 | 1/1980 | Perilstein | 44/53 |

*Primary Examiner*—Jacqueline V. Howard

*Attorney, Agent, or Firm*—Carl G. Ries; Robert A. Kulason; James J. O'Loughlin

[57] ABSTRACT

A corrosion-inhibited alcohol motor fuel composition comprising a major proportion of a lower aliphatic alcohol and a corrosion-inhibiting amount of a trimeric acid is provided.

9 Claims, No Drawings

CORROSION-INHIBITED ALCOHOL MOTOR FUEL COMPOSITION

BACKGROUND OF THE INVENTION

1. Field of the Invention

Lower aliphatic alcohols have been employed as fuels for internal combustion engines in specialized applications. For example, a high octane mixture of methanol and nitromethane has been employed as a fuel composition for racing cars and as a fuel for model airplane engines. Ethyl alcohol has been employed as a fuel for internal combustion engines when hydrocarbon fuels were not available. In general, however, aliphatic alcohol fuels have not been the fuels of choice for fueling either passenger or commercial motor vehicles throughout the developed world.

Actual or threatened shortages of crude oil from which to manufacture gasoline has resulted in significant steps to develop a liquid fuel for motor vehicles based on renewable sources. Ethyl alcohol meets this requirement since it can be produced from many agricultural products. A liquid fuel based on methyl alcohol is also promising since it can be produced as the end product of a partial oxidation process which employs either renewable agricultural products or substantially inexhaustible carbonaceous sources, such as coal or shale.

Automobiles having conventional internal combustion gasoline engines can be adapted to run on a liquid aliphatic alcohol fuel composition. However, serious corrosion problems have been encountered from the use of fuel compositions containing significant amounts of an alcohol.

2. Description of the Prior Art

U.S. Pat. No. 2,673,793 discloses a nitromethane-methanol fuel mixture which has been improved in its rapid combustibility by adding 2,2-dinitropropane.

U.S. Pat. No. 2,632,695 discloses a petroleum fuel composition which has been inhibited against rusting by the addition of an antirust dimeric acid or trimeric acid.

U.S. Pat. No. 2,673,144 discloses an auxiliary alcohol-water fuel composition consisting of from about 25 to 90 percent by weight of a lower alkanol having from 1 to 3 carbon atoms and about 10 to 75 percent by weight of water together with 500 to 2000 part per million of a chelating agent.

The disclosures of U.S. Pat. No. 2,632,695 and No. 2,673,144 are incorporated herein by reference.

SUMMARY OF THE INVENTION

A rust-inhibited alcohol fuel composition comprising a major proportion of a lower aliphatic alcohol and a minor rust-inhibiting amount of a trimeric acid produced by the condensation of an unsaturated aliphatic monocarboxylic acid or a hydroxy aliphatic monocarboxylic acid having between about 16 and about 18 carbon atoms per molecular is provided. The alcohol composition of the invention prevents or mitigates the problem of carburetor and fuel system corrosion which is critical in this type of fuel composition.

DESCRIPTION OF THE PREFERRED EMBODIMENTS

The trimeric acid additive of the invention is produced by the condensation of an unsaturated aliphatic monocarboxylic acid or hydroxy aliphatic monocarboxylic acid having between about 16 and about 18 carbon atoms per molecule. Trimeric acids have been produced by the heat polymerization of esters of the monocarboxylic acids to esters of the trimeric acids followed by hydrolysis. In another method, glycerides have been heat polymerized and the product hydrolyzed to yield trimeric acids. According to a method described in U.S. Pat. No. 2,482,761, a fatty oil such as sardine oil, is pressure split with water at 260° C. over reaction periods ranging from ½ to 1½ hours. The water is then withdrawn and the wet acids heated to 250° C. at a pressure of 250 lbs. per square inch for 4½ hours. The product is then heated at reduced pressure to distill off unpolymerized material until the desired polymerized trimeric acid is recovered.

Many naturally occurring fatty acids such as linseed fatty acids, soya bean fatty acids and the like can be polymerized to produce a trimer acid following the procedure disclosed in U.S. Pat. No. 2,482,761.

This process can also result in the formation of dimeric acids. In general, it has been found that dimeric acids do not impart a high level of corrosion inhibition to a liquid alcohol fuel composition. However, a minor amount of dimeric acid coproduced along with the prescribed trimeric acid, or left remaining mixed therewith following a separation process, that is an amount of dimeric acid ranging from between about 2 to about 20%, with the balance being the trimeric acid, which is generally representative of the trimeric acid products available in commerce, can be employed in the alcohol composition of the invention. The additional cost of removing the dimeric acid is not justified simply to avoid dilution of the prescribed trimeric acid additive.

Commercially available trimer acid or triethenoid acid is sold under the trade name "Empol 1040 Trimer Acid". This acid is produced by the polymerization of unsaturated $C_{18}$ fatty acids and is essentially a mixture of about 80% trimer acid and about 20% dimer acid and some residual monobasic acid. This acid is represented by the following formula:

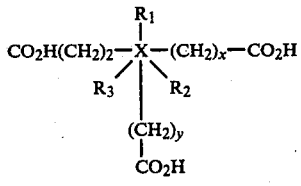

in which R, $R_1$, $R_2$ and $R_3$ represent alkyl side chains and X represents the linkage resulting from the polymerization of the unsaturated fatty acid molecules.

This additive has the following inspection values:

| | |
|---|---|
| Acid Value | 183–191 |
| Saponification Value | 192–200 |
| Trimer content, % | 80 |
| Dimer content, % | 20 |
| Specific gravity, 25°/20° C. | 0.975 |
| Pour Point, °F. | 55 |

The alcohol base for the composition of the invention is a lower aliphatic alcohol having generally from 1 to 4 carbon atoms. Specific alcohols which are suitable for forming the alcohol fuel composition include methanol, ethanol, 1-propanol, 2-propanol, isopropanol and the butanols, such as tertiary butyl alcohols. Mixtures of alcohols can also be employed for preparing the composition of the invention.

The alcohol base for the composition of the invention should consist of at least about 90 percent of alcohol. A preferred concentration of alcohol in the alcohol base is from 95 to 99.8 percent with the most preferred concentration being from about 98 to 99.5 percent. The balance of the base composition can consist of water and minor amounts of such impurities which are normally coproduced during the manufacture of the alcohol, namely, acids, formaldehydes and other alcohols. It will be appreciated that the alcohol compositions of this invention will be a fuel grade alcohol and will correspond to technical or commercial grades of alcohol. It is the technical or commercial grades of alcohol, herein referred to as a fuel grade alcohol, which presents a significant corrosion problem to the fuel systems of motor vehicles.

A typical fuel grade ethanol made from cane sugar will consist of from about 91 to 95 percent ethyl alcohol, from about 9 to 5 percent water and will contain minor amounts of acids, particularly acetic acid, aldehydes, particularly formaldehydes, esters, higher aliphatic alcohols and some residue or suspended impurities. In general, the minor impurities will be within the range of from about 0.5 to 10 milligrams per 100 milliliters of alcohol for each class of impurity. The presence of acid and significant amounts of water are believed to be primarily responsible for the metal corrosion problem.

The corrosion-inhibiting properties of the alcohol fuel composition of the invention and of a comparison fuel composition was determined in the Carburetor Metal Corrosion Test described below.

In this test, a clean strip of carburetor zinc metal is placed in a 120 milliliter tall form bottle. Fifty milliliters of fuel grade ethanol is added to the bottle covering about one-half of the metal strip. Eleven milliliters of distilled water are added to the bottle and the contents mixed by gently swirling for a few seconds. The bottle is stoppered and then stored in the dark at room temperature. Corrosion of the wetted metal surfaces is visually rated after 7 and 14 days storage.

A fuel grade ethyl alcohol consisting of about 92.5 percent ethanol, about 7.5 percent water and minor amounts of impurities including a maximum of 5.0 milligrams per 100 milliliters of residue, a maximum of 3.0 mg/100 ml acetic acid, a maximum of 6.0 mg/100 ml of aldehyde, a maximum of 8.0 mg/100 ml of esters and a maximum of 6.0 mg/100 ml of higher alcohols was employed to evaluate the effectiveness of the fuel composition of the invention. The additive employed in the fuel composition of the invention was Trimer acid (Empol 1040) which is a product of Emery Industries and consists of about 80% of the trimer of linoleic acid.

The comparison additive employed in the examples below was Dimer acid (Empol 1022) which is also a product of Emery Industries and consists of about 75% of the dimer of linoleic acid.

The corrosion test results are set forth in Table I below:

TABLE I

CARBURETOR METAL (ZINC) CORROSION TEST

| | % SURFACE CORROSION | |
|---|---|---|
| | 7 days | 14 days |
| Dimer Acid (Empol 1022) 2PTB[1] | 45 | 100 |
| Trimer Acid (Empol 1040) 2PTB | 1 | 25 |

[1]PTB - pounds of additive per 1000 barrels of fuel.

The foregoing tests demonstrate the effectiveness of Trimer Acid as a carburetor metal corrosion-inhibiting additive in a fuel grade ethyl alcohol composition. The results were surprising in view of the relative ineffectiveness of the closely related Dimer Acid which is derived from the same source, namely a dimer of linoleic acid.

We claim:

1. A motor fuel composition comprising a major proportion of ethyl alcohol, from about 5 to 9 percent water and from about 0.0005 to 0.1 weight percent of an additive comprising at least 80 percent of a trimeric acid produced by the condensation of an unsaturated aliphatic monocarboxylic acid or a hydroxy aliphatic monocarboxylic acid having between about 16 and about 18 carbon atoms per molecule.

2. A motor fuel composition according to claim 1 in which said trimeric acid is produced from the condensation of linoleic acid.

3. A motor fuel composition according to claim 1 containing from about 0.5 to 10 milligrams of acetic acid per 100 milliliters of said ethyl alcohol.

4. A motor fuel composition comprising a major proportion of a lower aliphatic alcohol having from 1 to 4 carbon atoms, from about 0.2 to 10 percent water and from about 0.0005 to 0.1 weight percent of an additive comprising at least 80 percent of a trimeric acid produced by the condensation of an unsaturated aliphatic monocarboxylic acid or a hydroxy aliphatic monocarboxylic acid having between about 16 and 18 carbon atoms per molecule.

5. A motor fuel composition according to claim 4 containing from about 5 to 9 percent water.

6. A motor fuel composition according to claim 4 in which said trimeric acid is produced from the condensation of linoleic acid.

7. A motor fuel composition according to claim 4 in which said lower aliphatic alcohol is ethyl alcohol.

8. A motor fuel composition according to claim 4 containing from about 0.5 to 10 milligrams of acetic acid per 100 milliliters of said aliphatic alcohol.

9. A motor fuel composition according to claim 4 in which said lower aliphatic alcohol is methanol.

* * * * *